US006067672A

United States Patent [19]

Klotz

[11] Patent Number: 6,067,672

[45] Date of Patent: May 30, 2000

[54] SHOWER CURTAIN CLOSURE ASSEMBLY

[76] Inventor: Ronald E. Klotz, P.O. Box 81, Wolfpoint, Mont. 59201

[21] Appl. No.: 09/262,627

[22] Filed: Mar. 4, 1999

Related U.S. Application Data

[60] Provisional application No. 60/077,335, Mar. 9, 1998.

[51] Int. Cl.[7] ..... A47K 3/22; A47K 3/34; A47K 3/36

[52] U.S. Cl. ..... 4/609; 4/558; 160/349.1; 160/399

[58] Field of Search ..... 4/557, 558, 605, 4/607, 608, 609, 610; 160/349.1, 349.2, 327, 330, 348, 368.1, 196.1, 391, 399, DIG. 8, 402, 403, DIG. 6; D23/304–307; 248/316.1, 316.4, 316.6

[56] References Cited

U.S. PATENT DOCUMENTS

| | | | |
|---|---|---|---|
| D. 284,024 | 5/1986 | Olson | D23/69 |
| 4,361,915 | 12/1982 | Siewert | 4/609 |
| 4,759,087 | 7/1988 | Zeilinger | 4/605 |
| 4,765,001 | 8/1988 | Smith | 4/609 |
| 4,771,517 | 9/1988 | Bonanno | 24/462 |
| 4,887,324 | 12/1989 | Cairns | 4/609 |
| 4,944,050 | 7/1990 | Shames et al. | 4/609 |
| 5,070,551 | 12/1991 | Harrison et al. | 4/608 |
| 5,148,580 | 9/1992 | Dyckow | 24/303 |
| 5,274,859 | 1/1994 | Redman et al. | 4/608 |
| 5,305,477 | 4/1994 | Cochran | 4/609 |
| 5,450,889 | 9/1995 | Jones et al. | 160/330 |
| 5,606,752 | 3/1997 | Shenton, Jr. et al. | 4/609 |

*Primary Examiner*—David J. Walczak
*Assistant Examiner*—Tuan Nguyen
*Attorney, Agent, or Firm*—Jerry Johnson

[57] ABSTRACT

A closure assembly for semi-permanent securement of an edge of the curtain to a wall of a shower enclosure. The closure assembly includes a clamping structure which comprises a mounting bar for permanent securement to a wall of a shower enclosure. The mounting bar includes a wall attachment surface for attachment to a wall of a shower enclosure and a first clamping surface. The mounting bar further including a plurality of first fastener receiving holes. Supported on the mounting bar is an adjustable clamp including a second clamping surface which is disposed adjacent to the first clamping surface. The adjustable clamp includes a plurality of second fastener receiving holes. The first fastener receiving holes of the mounting bar are aligned with the second fastener receiving holes of the adjustable clamp. A plurality of threaded fasteners are disposed such that a threaded fastener engages each of the aligned first and second holes for securing the adjustable clamp to the mounting bar. A first curtain edge is disposed between the first and second clamping surfaces. The fasteners may be selectively tightened from a first position where the adjustable clamp is loosely secured to the first clamping surface such that the first curtain edge may be easily disposed between the first and second clamping surfaces, to a second water proof position where the fastener is under tension and applies a compressive clamping force on the first and second clamping surfaces as well as the intervening first curtain edge. The compressive clamping force applied to the first curtain edge by the fastener in the second position exceeds the shear strength of the curtain such that a force which exceeds the shear strength of the curtain applied to the curtain first edge will result in the tearing of the curtain before the release of the edge of the curtain from the position between the first and second clamping surfaces.

9 Claims, 4 Drawing Sheets

SHOWER CURTAIN CLOSURE ASSEMBLY

RELATED APPLICATIONS

The present application claims the benefit under Title 35, United States Code, Section 119E of the United States Provisional Patent application Ser. No. 60/077,335 filed Mar. 9, 1998 entitled "Shower Curtain Enclosure Apparatus" by the same inventor as the present application.

BACKGROUND

Shower enclosures typically comprise a permanent back wall and two permanent opposing side walls. One of the side walls typically includes a shower fixture having a water spraying shower head. A shower curtain or shower door is used to close off the front of the shower enclosure. The shower curtain or door is typically disposed between the two opposing side walls.

Shower curtains are often preferable to the more permanent shower door constructions. Shower curtains are usually manufactured from flexible water proof plastic sheet material and as a result are much less expensive than door assemblies made of expensive rigid plastic or glass. Additionally, shower curtains require only a simple support rod for the curtain to be hung in place between the opposing side walls of the enclosure. Accordingly, the shower curtains can be easily replaced at little cost and effort if the curtain is damaged or if a different color or style of curtain is desired.

A disadvantage associated with shower curtains is the tendency of water spray from the shower head to escape through a gap which separates the side edges of the shower curtain from the side walls of the shower enclosure. This escaping water spray will end up on wall and floor surfaces causing water damage to these surfaces, as well as to the underlying wall and floor structures. Additionally, even a small amount of water can make floor surfaces extremely slippery and dangerous.

Numerous attempts have been made at retaining the edges of the shower curtain at the side walls of the shower enclosure to effectively seal the shower enclosure from escaping water spray. These attempts typically use a shower curtain closure assembly which is attached to the side wall. The closure assembly retains the edge of the shower curtain within the assembly.

Previous shower curtain closures of this type include inexpensive plastic moldings which have a resilient clip structure. The shower curtain edge may be supported on a rod which is then pressed into a pair of resilient arms and semi-permanently retained within the assembly. Alternatively, the molding may include a third arm which holds the edge of the curtain. This third arm then can be pressed between a pair of opposing resilient arms while the edge of the curtain is held on the third arm. This structure also semi-permanently retains the curtain edge within the assembly.

There have been problems with closure assemblies of this type. Water may enter into the recess between the two resilient arms, as well as into other recesses within the structure. This tendency to retain water allows mold and mildew growth to occur in these areas.

Additionally, the closure assemblies of this type have suffered from poor appearance. Specifically, the assemblies look incongruous with current shower enclosures and bath tub shower stalls.

An additional problem with these closure assemblies is the poor retention of the shower curtain within the assembly.

These assemblies are designed to provide a semi-permanent securement of the edge of the curtain within the assembly. Unfortunately, these closure assemblies have insufficient retention strength. Accordingly, the curtain edge may be pulled from the assembly without much effort. The assemblies typically require the entire edge to be installed within the assembly at one time. So, if a portion of the edge has been pulled from the assembly, it is likely that the user will not remove the remainder of the curtain from the assembly to permit the reinstallation of the entire edge. Because of this, the curtain may be allowed to remain only partially retained within the assembly. This situation defeats the purpose of the assembly of restricting the escape of water spray between the shower curtain and the side wall. Additionally, the shower curtain will remain in an unsightly arrangement.

Other shower curtain closure assemblies have been designed for the temporary retention of the shower curtain edge within the assembly. Some of these closure assemblies have included the use of simple fabric hook and loop type fasteners which are unsightly and undesirable due to the tendency of these fasteners to lose their retention strength after a period of extended use. The fabric used in these fasteners also retains water which will allow mold and mildew growth.

Other shower curtain closure assemblies which are designed for the temporary retention of a shower curtain edge rely on a structure that applies a light clamping pressure on the edge of the curtain to hold the curtain in place. These clamping assemblies may use simple clamps that are biased by a light spring. Other temporary clamping assemblies use flexible plastic fingers that can be flexed rearwardly to allow the curtain to be disposed under the finger, and then allowed to flex forwardly against the edge of the curtain. Although minimal effort is required to retain the shower curtain within these closure assemblies, it is often true that most users will not bother to retain the shower curtain in the assembly. For this reason, these assemblies are most effective in positions that are unaffected by the entry or exit of the shower user. If the closure of this type is used at the position on the curtain where entry and exit take place, it is unlikely that the user will take the time to position the curtain within the assembly. Because of this the sealing benefits from the use of these assemblies are often never realized. If the assembly is used on the opposite edge of the curtain from where the user enters and exits the shower enclosure, the retention of the curtain edge is minimal which often results in the quick detachment of the curtain from the closure.

For the previously mentioned reasons, there is a need for a shower curtain closure assembly that is useful for a sealing securement of one edge of a shower curtain. There is a need that this closure assembly provides a semi-permanent securement for the shower curtain which will not permit detachment of the curtain unless desired. There is a further need that this closure provide a sealing attachment of the curtain to a wall of the shower enclosure such that water may not pass between the curtain and the wall. There is a need that this closure assembly does not retain water and minimizes the likelihood that hard water deposits, as well as mold and mildew will not form on the closure assembly. There is a further need that this closure is pleasant in appearance and will not appear incongruous with the remainder of the shower enclosure or bathroom.

SUMMARY

The present invention satisfies the previously mentioned needs for a shower curtain closure assembly.

The present invention comprises a closure assembly for semi-permanent securement of an edge of the curtain to a wall of a shower enclosure. The closure assembly includes a clamping structure which comprises a mounting bar for permanent securement to a wall of a shower enclosure. The mounting bar includes a wall attachment surface for attachment to a wall of a shower enclosure and a first clamping surface. The mounting bar further including a plurality of first fastener receiving holes. Supported on the mounting bar is an adjustable clamp including a second clamping surface which is disposed adjacent to the first clamping surface. The adjustable clamp includes a plurality of second fastener receiving holes. The first fastener receiving holes of the mounting bar are aligned with the second fastener receiving holes of the adjustable clamp. A plurality of threaded fasteners are disposed such that a threaded fastener engages each of the aligned first and second holes for securing the adjustable clamp to the mounting bar.

A first curtain edge is disposed between the first and second clamping surfaces. The fasteners may be selectively tightened from a first position where the adjustable clamp is loosely secured to the first clamping surface such that the first curtain edge may be easily disposed between the first and second clamping surfaces, to a second water proof position where the fastener is under tension and applies a compressive clamping force on the first and second clamping surfaces as well as the intervening first curtain edge. The compressive clamping force applied to the first curtain edge by the fastener in the second position exceeds the shear strength of the curtain such that a force which exceeds the shear strength of the curtain applied to the curtain first edge will result in the tearing of the curtain before the release of the edge of the curtain from the position between the first and second clamping surfaces.

The first clamping surface typically extends substantially parallel to the plane of the shower curtain and extends substantially perpendicularly to the wall attachment surface. Each of the first and second holes are typically unthreaded through holes and the fasteners are typically non-corroding threaded bolts.

The mounting bar is usually "T" shaped beam having a flange and a web. The wall attachment surface is disposed on the flange, and the first clamping surface is disposed on the web. The web is attached to the flange proximate to the mid portion of the flange. The web extends from the flange in a substantially perpendicular orientation.

The mounting bar is typically substantially the height of the shower curtain from the top to bottom, and is typically used with shower curtains constructed from a flexible sheet vinyl or other plastic material.

The closure assembly for a shower curtain of the present invention satisfies the previously mentioned need for a shower curtain closure assembly that is useful for a sealing securement of one edge of a shower curtain. The closure assembly provides a sealing attachment of the curtain to a wall of the shower enclosure such that water may not pass between the curtain and the wall. The closure assembly provides a semi-permanent securement for the shower curtain which will not permit detachment of the curtain unless desired. This feature ensures that the curtain will remain within the closure and that water damage resulting from a detached curtain will not occur.

The closure assembly for a shower curtain of the present invention does not retain water and minimizes the likelihood that hard water deposits, as well as mold and mildew will not form on the closure assembly. This results in an assembly that has no special cleaning requirements, and will likely remain cleaner that the shower enclosure in which it is used.

The closure assembly is pleasant in appearance and will not appear incongruous with the remainder of the shower enclosure or bathroom. The closure uses high quality plastics in a well designed assembly that is inconspicuous in all types of bathrooms including bathrooms having modern architectural features, traditional residential bathrooms, motel or rental unit bathrooms, and institutional bathrooms. The closure assembly is usable in all types of shower enclosures including shower stalls and bath tub stalls. The closure assembly is also usable with the plastic waterproof liners of multiple layer curtains that typically include a fancy cloth exterior layer.

The closure assembly is simple in construction yet very strong and durable. The closure assembly also includes no breakable moving parts.

The closure assembly of the present invention provides a benefit which has been previously unavailable in closures and other retention devices for shower curtains. The closure assembly provides a level of retention which exceeds the strength of the curtain. Should someone slip in a shower enclosure or outside of the enclosure, the shower curtain is often the only thing available which can be grabbed by the person to regain their balance. If the person grabs the shower curtain retained in the closure of the present invention, the person can rely on the curtain to be secure as it will not pull from the closure. If the person does not regain their balance and continues to fall, after having grabbed the shower curtain of the present invention, the strength of the closure assembly and the strength of the retention of the shower curtain within the closure assembly ensure that the curtain will tear under the weight pulling on the curtain. Although this would not prevent the fall, it would result in a substantial breaking of the fall which would possibly prevent injury. This strength property is a distinct difference from previous shower curtain closures that would not assist someone relying on the curtain in the event of a fall. Such falls, although not common in most households, are more common in institutional settings such as retirement homes.

DRAWINGS

DESCRIPTION

Figure 1:
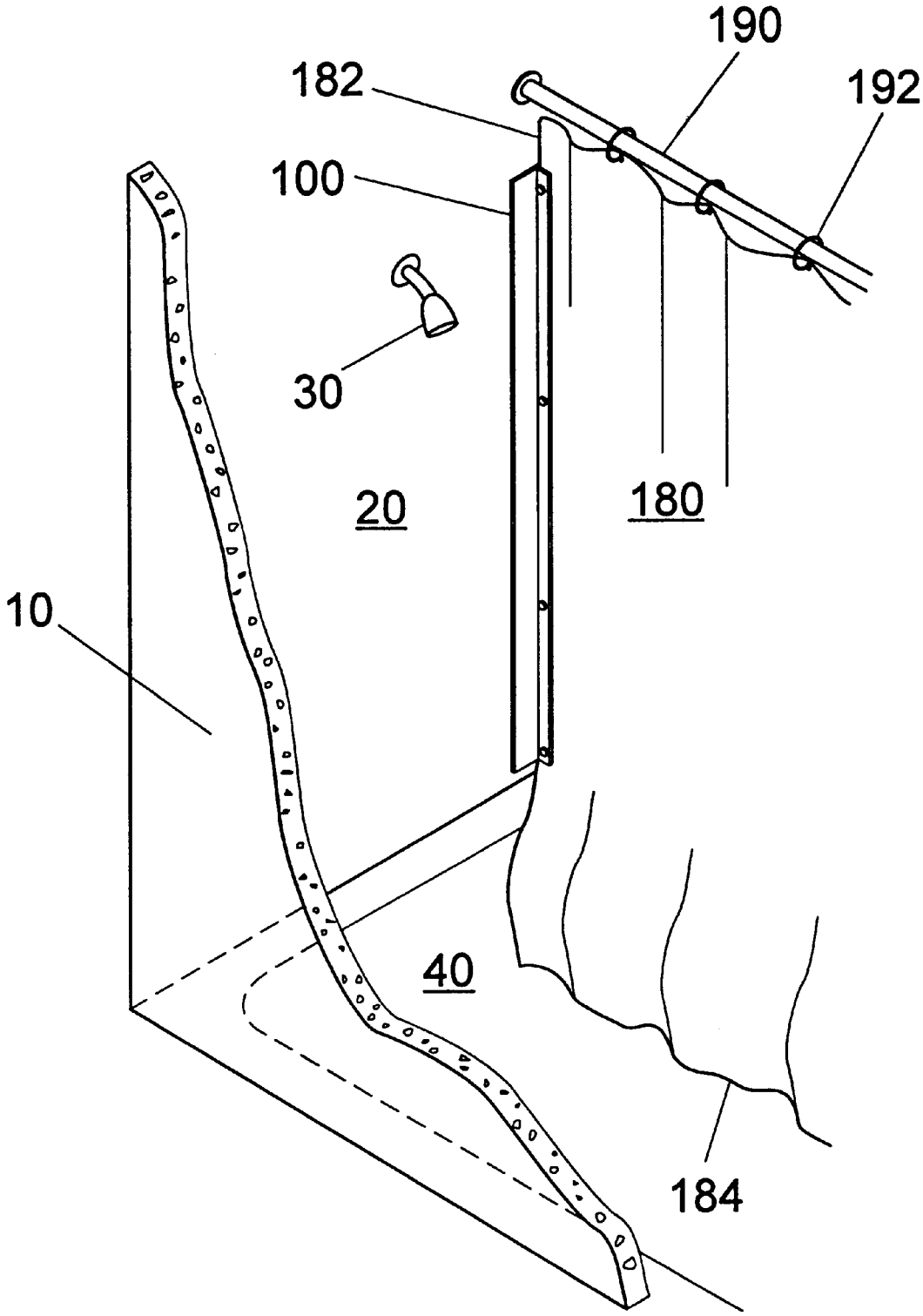
FIG. 1 is a perspective view showing the shower curtain closure assembly of the present invention disposed in a shower enclosure.

FIG. 1 is a perspective view showing the shower curtain closure assembly 100 of the present invention. The view is looking through the back wall 10 of the shower enclosure. The closure assembly 100 is disposed on a side wall 20 of the shower enclosure. Side wall 20 additionally includes a shower head 30 which is the source of water spray which the closure assembly 100 is designed to contain. Securely retained within the closure assembly 100 is the vertical edge 182 of shower curtain 180. Shower curtain 180 is hung from curtain rod 190 using rings 192. The shower curtain bottom 184 is shown extending into a bath tub 40. The shower curtain is disposed opposite the back wall 10 of the shower enclosure. The shower curtain serves to close the shower enclosure. The closure assembly prevents water spray from the shower head from passing out of the shower enclosure through any gaps that would otherwise exist between the vertical edge 182 of the shower curtain 180 and the side wall 20.

Figure 2:
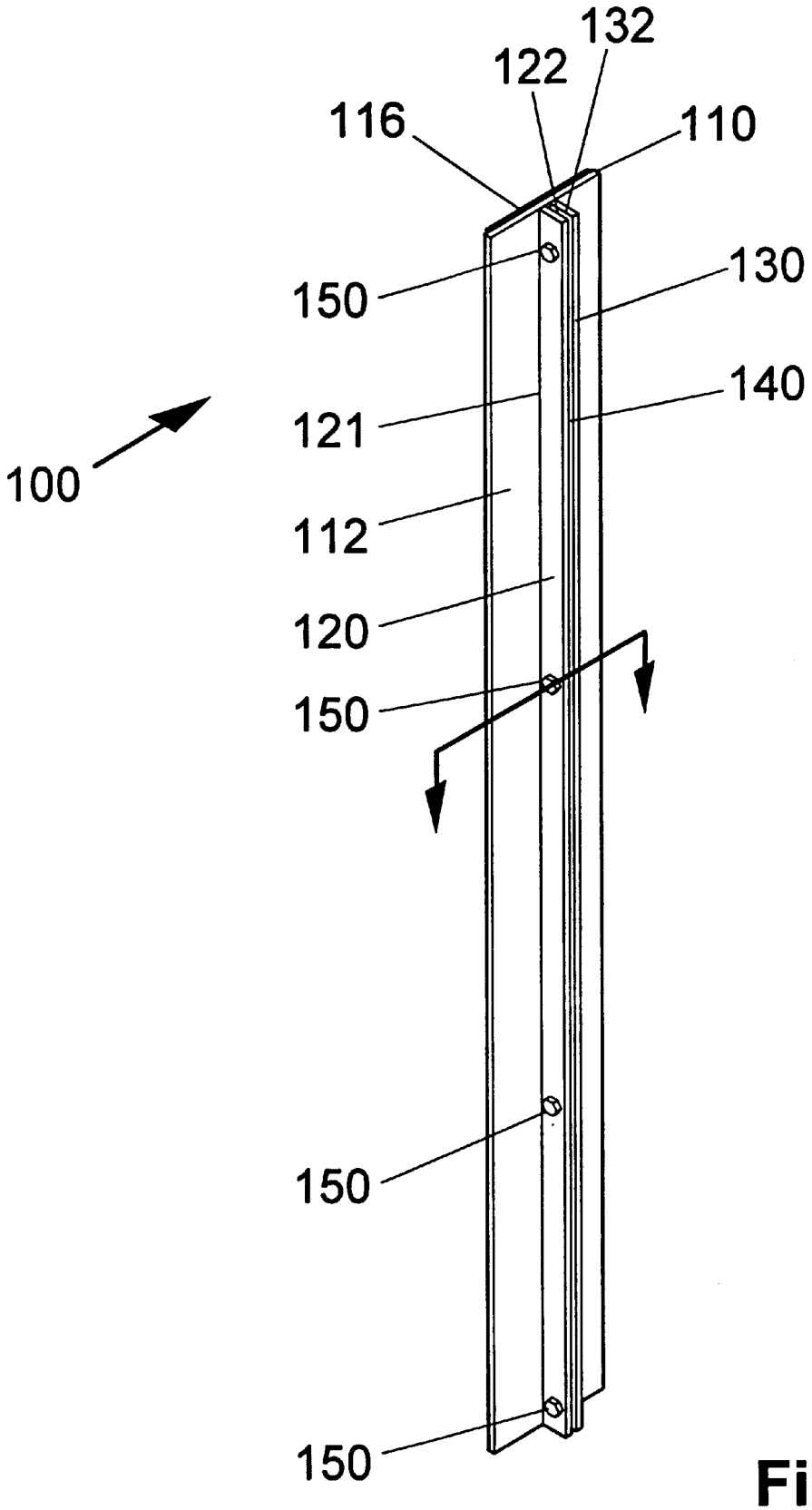
FIG. 2 shows a perspective view of the closure assembly.

FIG. 2 shows a perspective view of the closure assembly 100. The closure assembly includes a "T" shaped mounting bar having a flange 110 and a web 120 which extends perpendicular to the flange. The flange 110 and a web 120 of the "T" shaped mounting bar are typically constructed of quarter inch thick plexiglass. Other materials which could be used include high strength plastics, aluminum, and stainless steel. An edge 121 of the web 120 is permanently attached to the front surface 112 of the flange 110, approximately at the middle of the flange 110. The flange back surface includes mounting adhesive tape 116.

An adjustable clamp 130 is secured to the web 120 by a series of vertically spaced fasteners 150. The adjustable clamp 130 is similar in size (length, width and thickness) and material to the web 120 of the mounting bar. A gap 140 for receiving a vertical edge of a shower curtain is shown separating a first clamping surface 122 disposed on the web 120, from a second clamping surface 132 disposed on the adjustable clamp 130.

Figure 3:
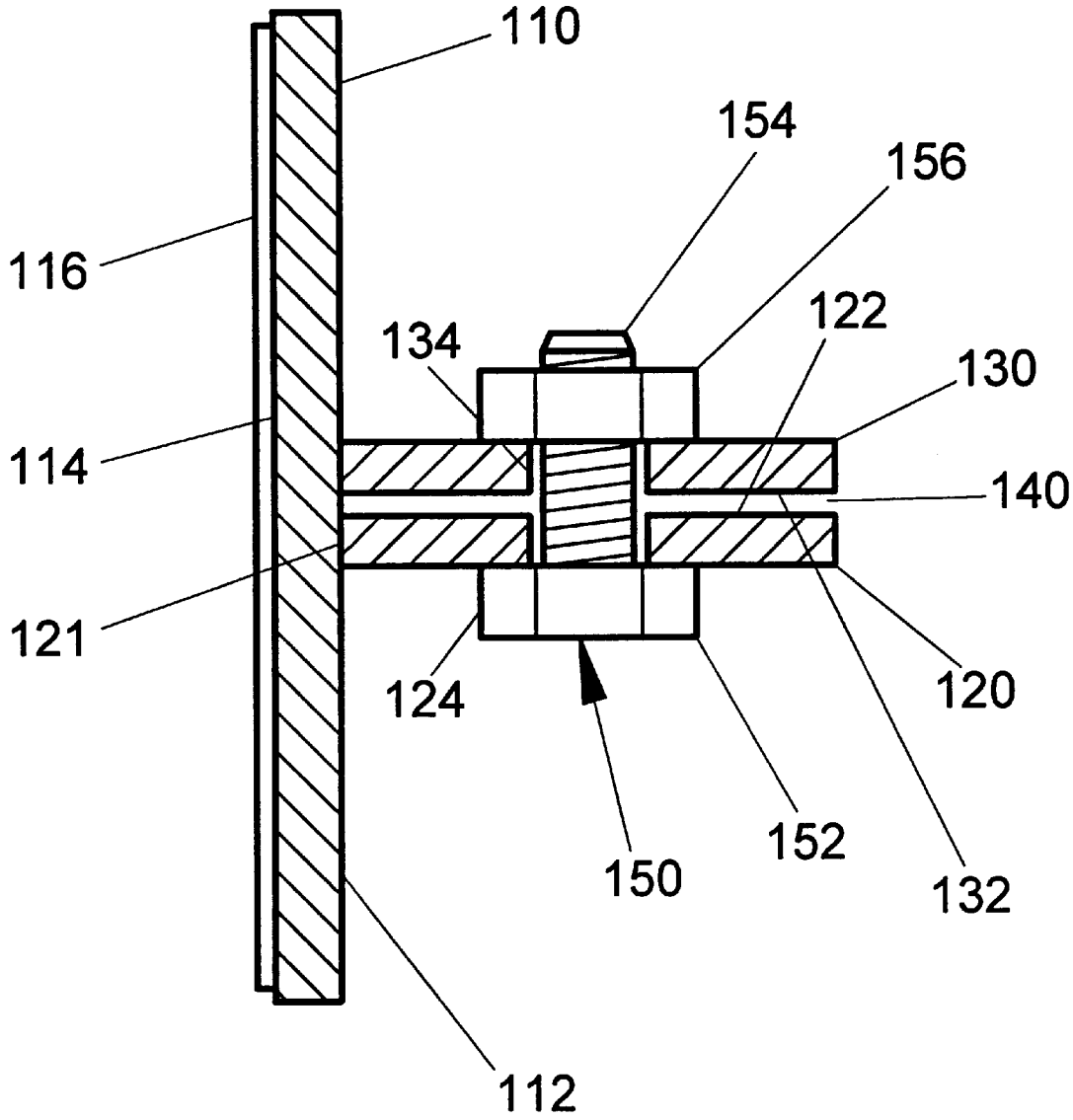
FIG. 3 shows a cross-sectional top view of the closure assembly.

FIG. 3 shows a cross-sectional top view of the closure assembly 100. In this view, the parallel opposing first and second clamping surfaces 122 and 132 are shown being separated by a curtain receiving gap 140. Threaded fastener 150 which includes a head 152, a threaded shaft 154, and a threaded nut 156 is shown extending through a first through hole 124 in the web 120, and a second through hole 134 in the adjustable clamp 130. The threaded fastener 150 loosely holds the adjustable clamp 130 in the proper position adjacent to the mounting bar. Should the user desire to remove the adjustable clamp 130 from the mounting bar, the user would merely need to remove nuts 156 of the threaded fasteners 150.

The fastener 150 in this figure is shown in a loosened condition suitable for placement of the edge of a shower curtain between the parallel opposing clamping surfaces 122 and 132. In this loosened condition, the fasteners are not under any tension. The threaded fastener in this figure is a high strength nylon fastener. Other non-corroding materials which could be used for the fasteners include aluminum, stainless steel, and other high strength plastics.

FIG. 3 also shows a high strength adhesive which is typically a double sided tape 116 which is mounted on the back surface 114 of the flange 110. This adhesive forms a permanent securement of the mounting bar on the side wall 20 of the shower enclosure.

Figure 4:
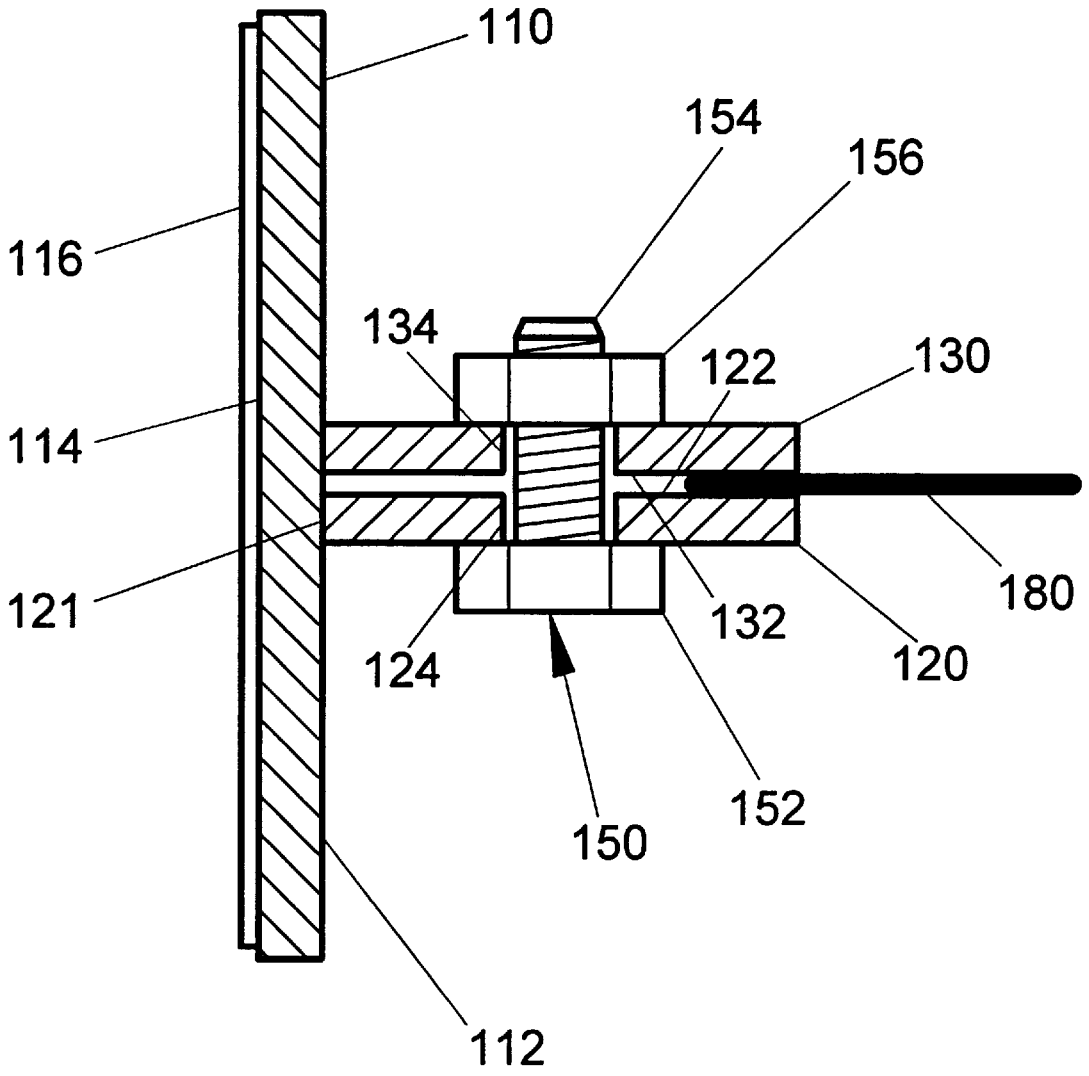
FIG. 4 shows a cross-sectional top view of the closure assembly and a shower curtain.

FIG. 4 shows the side edge of a shower curtain 180 secured between the parallel opposing first and second clamping surfaces 122 and 132. In this figure, the fastener has been tightened to move the adjustable clamp 130 toward the web 120, which moves the second clamping surface toward first clamping surface 122. The fastener 150 may be tightened from a first position where the fastener is loose and is not under any tension so that the curtain can be disposed between the clamping surfaces, to a second position where the fasteners are under tension and the clamping surfaces 132 and 122 apply a compressive clamping force on the edge of the shower curtain 180.

The shower curtain 180 is typically constructed of a vinyl sheet having a thickness of 6 mils to 12 mils. The adjustable clamp can accommodate a wide range of thicknesses of shower curtains. Should the curtain include a border or built up edge, it would still easily fit between the opposing clamping surfaces of the closure assembly 100, and also be easily secured by a compressive clamping force applied by the fasteners.

In the fully tightened condition, the tensioned fasteners are easily able to apply a compressive clamping force on the edge of the curtain which will retain the edge of the curtain under essentially all situations. If a force exceeding the shear strength is applied to the curtain, the curtain will tear under the applied forces before the curtain edge will be released by the closure assembly.

Such forces are unlikely, of course. However, because the closure assembly is able to provide such a secure retention of the shower curtain, it ensures that the shower curtain will be secured semi-permanently within the closure assembly. Semi-permanent in this usage describes the degree of securement provided by the closure assembly of the present invention. Only the intentional loosening of the fasteners will allow the edge of the curtain to be removed from the closure assembly. Should a falling person grab the curtain while falling, it is quite possible that the injuries sustained will be minimal as the curtain will likely break their fall to some extent. The semi-permanent securement of a shower curtain edge provided by the closure of the present invention in no way inhibits the ease in which a shower curtain may be repositioned within the closure, or the ease in which the curtain may be replaced with a new curtain.

FIG. 4 also shows how the curtain extends from the closure assembly with the curtain extending in a parallel plane to the web and the adjustable clamp. This arrangement provides a clean appearance to the attachment of the curtain edge to the closure assembly.

It is understood that various modifications and changes in form or detail could readily be made without departing from the spirit of the invention. An example of such a modification would be the use of an extruded or molded "T" shaped mounting bar, threaded holes or threaded inserts disposed within the adjustable clamp replacing the use of nuts, and the use of the closure assembly on the ceiling as a hanging device for a curtain. Other such modifications have been previously mentioned within the description of the invention. It is therefore intended that the invention be not limited to the exact form and detail herein shown and described, nor to anything less than the whole of the invention herein disclosed and as herein after claimed.

I claim:

1. A water proof shower curtain and a closure assembly for securing an edge of the curtain to a wall of a shower enclosure comprising:

a closure assembly comprising:

a mounting bar for securement to a wall of a shower enclosure, the mounting bar including a wall attachment surface for attachment to the wall of a shower enclosure; and a first clamping surface; the mounting bar further including a plurality of first fastener receiving holes;

an adjustable clamp including a second clamping surface disposed adjacent to the first clamping surface; the adjustable clamp including a plurality of second fastener receiving holes; wherein the first fastener receiving holes of the mounting bar are aligned with the second fastener receiving holes of the adjustable clamp; and a plurality of threaded fasteners, wherein a threaded fastener engages each of the aligned first and second holes for securing the adjustable clamp to the mounting bar;

a substantially water proof shower curtain comprising a plastic sheet having a plurality of side edges; wherein the side edges do not include perforation for the passage of the threaded fasteners;

wherein a first curtain edge is disposed between the first and second clamping surfaces; and, wherein the fasteners do not pass through the first curtain edge;

wherein the fasteners may be selectively tightened from a first position where the adjustable clamp is loosely secured to the first clamping surface such that the first curtain edge may be easily disposed between the first and second clamping surfaces; to a second water proof position where the fastener is under tension and applies a compressive clamping force on the first and second clamping surfaces as well as the intervening first curtain edge; and wherein the compressive clamping force applied to the first curtain edge by the fastener in the second position exceeds the shear strength of the curtain such that a force which exceeds the shear strength of the curtain applied to the curtain first edge will result in the tearing of the curtain before the release of the edge of the curtain from the position between the first and second clamping surfaces, and wherein removal of the curtain from the position between the first and second clamping surfaces requires the loosening of the threaded fasteners.

2. The closure assembly of claim 1, wherein the first clamping surface extends substantially parallel to the plane of the shower curtain.

3. The closure assembly of claim 1, wherein the first clamping surface extends substantially perpendicularly to the wall attachment surface.

4. The closure assembly of claim 1, wherein each of the first and second holes are unthreaded through holes.

5. The closure assembly of claim 1, wherein the mounting bar includes a T-shape having a flange and a web; wherein the wall attachment surface is disposed on the flange, and wherein the first clamping surface is disposed on the web, and wherein the web is attached to the flange proximate to the mid portion of the flange; and wherein the web, extends from the flange in a substantially perpendicular orientation.

6. The closure assembly of claim 1, wherein the mounting bar is of a length to securely retain a substantial portion of the vertical edge of the shower curtain.

7. The closure assembly of claim 1, wherein the shower curtain is constructed from a flexible vinyl plastic sheet.

8. The closure assembly of claim 1, wherein the shower curtain is constructed of vinyl.

9. The closure assembly of claim 8, wherein the shower curtain has a thickness of 6 to 12 mils.

* * * * *